United States Patent [19]

Schonberg

[11] Patent Number: 4,967,912

[45] Date of Patent: Nov. 6, 1990

[54] BYPASS MECHANISM FOR MAGNETIC SEPARATOR

[76] Inventor: David J. Schonberg, Rte. 3, Box 353, Alexandria, Minn. 56308

[21] Appl. No.: 338,304

[22] Filed: Apr. 14, 1989

[51] Int. Cl.[5] ..... B30B 3/04

[52] U.S. Cl. ..... 209/636; 100/902; 198/360; 209/215; 209/228

[58] Field of Search ..... 209/636, 930, 215, 218, 209/219, 228; 100/902; 198/360, 369, 370

[56] References Cited

U.S. PATENT DOCUMENTS

| | | | |
|---|---|---|---|
| 3,749,240 | 7/1973 | Spears et al. | 209/636 X |
| 4,059,050 | 11/1977 | Davis et al. | 209/215 X |
| 4,084,496 | 4/1978 | Ehernberger | 209/636 X |
| 4,119,024 | 10/1978 | White | 100/902 X |
| 4,516,489 | 5/1985 | Ballo | 100/902 X |

FOREIGN PATENT DOCUMENTS

| | | | |
|---|---|---|---|
| 0071875 | 6/1979 | Japan | 100/902 |

*Primary Examiner*—Donald T. Hajec

[57] ABSTRACT

A method utilizing a simple mechanism to circumvent the effect of the magnetic conveyor head (12) of a magnetic separator (11), whereby ferrous material such as steel cans can be diverted from the stationary reject chute (13) to go instead to the place where nonferrous materials go. The mechanism, called a movable chute (14), is actually a movable extention of the stationary reject chute (13) and pivots up or down on a hinge device (15) that connects it to the stationary reject chute (13). It can be secured in the up position by a latching device (16). It can be maintained at a constant angle in the down position by a stopping device (17). Edges (18) to the movable chute are provided to prevent material from falling off the sides. These edges are mounted either on the movable chute or on the sides of the magnetic separator. In the latter case they are called stationary guides (19). When the movable chute (14) is in the up position it forms a straight extension to the stationary reject chute (13). When it is in the down position it creates a downward chute that directs ferrous material away from the stationary reject chute (13) and into the chamber where ordinarily only nonferrous material would go.

4 Claims, 1 Drawing Sheet

BYPASS MECHANISM FOR MAGNETIC SEPARATOR

FIELD OF INVENTION

This invention relates to magnetic seprrators, and more particularly to a movable chute for magnetic separators used in recycling aluminum and steel cans.

BACKGROUND OF THE INVENTION

The magnetic separator used by the aluminum can recycling industry is a belt conveyor that runs over a magnetized pulley referred to as a "magnetic conveyor head". Any ferrous material such as steel beverage cans is attracted to the magnetic conveyor head. Whereas the aluminum cans fall off the conveyor as soon as the upper run of the conveyor belt beneath them comes to the magnetic conveyor head and begins to follow it around, the steel cans are drawn to the magnet. Only after the steel cans are carried half way around the magnetic conveyor head, and the conveyor belt actually begins to leave the magnet do they fall off. At this point the steel cans are diverted into a separate chute referred to as the "stationary reject chute " which sends them to the reject barrel.

Very elaborate equipment has been developed over the years to automate the recycling of aluminum beverage cans. Among other things, the magnetic separator is often combined with a hydraulic press referred to as a "densifier" which compresses the cans into small bricks called "biscuits". A mixture of cans can be dumped into the hopper of a separator/densifier. In a single operation the steel cans are separated from the aluminum cans, the aluminum cans are densified, and the steel cans rejected.

Recent trends in the recycling industry, however, are beginning to outdate some of this expensive equipment. For one thing, steel cans have begun to have value. The broadening base of the recycling industry has turned attention to steel cans. There is still a need to keep the different metals separate. But instead of throwing the steel cans away, it has now become desirable to biscuit them up and sell them. The problem which arises with conventional equipment is steel cans cannot be processed by the automated equipment because the magnetic conveyor head keeps rejeting them.

There are two solutions to this problem namely, buy expensive equipmetn that will process steel cans or somehow bypass the magnetic conveyor head on the separator. My invention is a very simple mthod to circumvent hte effect of the magnetic conveyor head. By permitting existing eqipment to do double duty, my invention eliminates the need to spend hundreds and even thousands of dollars on additional equipemtn.

SUMMARY OF THE INVENTION

It is an object of this invetion to provide a conveyor apparatus having a magnetic head with a bypass, a movable chute that permits a luminum or steel cans to be selectively directed int oa densifier or the like.

In carrying out the invention, I provide a conventional magnetic head conveyor apparatus with a mopvable chute adjacent the discharge end of the conveyor. The chute is shiftable between elevated and lowered positions. When the chute is in the elevated position, it serves as a continuation of the lower wall of the stationary chute and supports and directs steel cans or the like to a collection point. Aluminum cans are discharged from the conveyor belt into a densifier or other collection station. When in the lower position, the chute serves to direct steel cans into a densifier or other collection station.

The use of my novel chute with a magnetic head conveyor saves money, space, and labor. It would be possible, for instance, to but an additional conveyor—one without a magnet—that would run steel cans into the densifier. By using one standard industry item, however, and merely incorporating an inexpensive modification, a great deal of money can be saved.

Furthermore, my invention ultimatley saves space. Between the need to economize and the need to process large quantities of material in oreder to make any money, a typical recycling shop is always short of space. By combining into one machine the work of two machines, the need to find room for another piece of equipment is eliminated.

Thirdly, my invention saves labor. Without my invention the operator would be required to physically move either one machine into place or the other depending upon whether he wanted to run steel cans or aluminum cans. My invention requires only a very simple adjustment, taking but a few seconds, and one versatile machine is ready to process either steel cans or aluminum cans.

FIGURES OF THE DRAWINGS

DESCRIPTION OF THE PREFERRED EMBODIMENT

Figure 1:
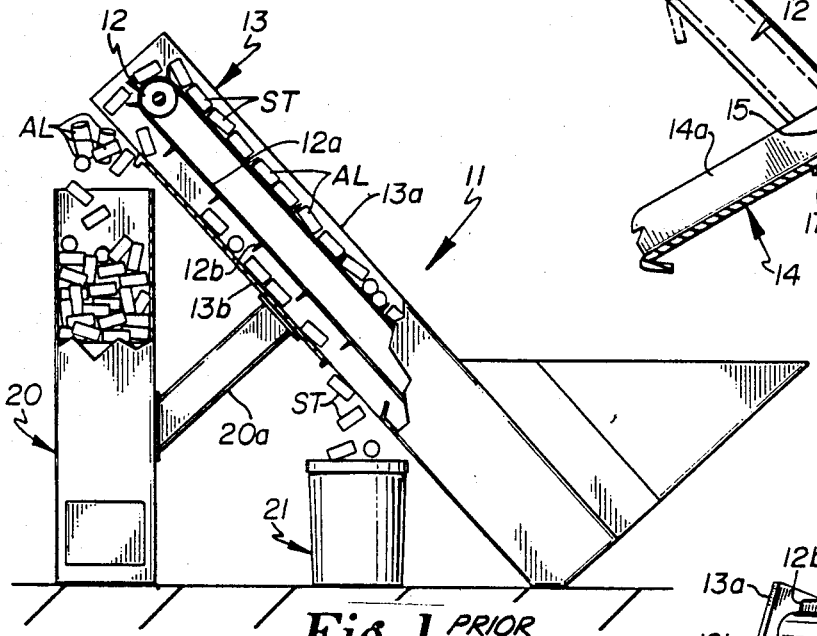
Fig. 1 PRIOR ART
FIG. 1 is a diagrammatic side elevational view of a conventional separator/densifier with certain parts thereof broken away for clarity illustrating how magnetic conveyor head separates steel cans from aluminum.

A typical separator/densifier, designated generally by the reference numeral 11, is illustrated by FIG. 1. This particular drawing closely resembles the CD500 Can Densor manufactured by CP Manufacturing, Inc. of National City, Calif. Physical appearance of separator/densifiers varies from model to model and from manufacturer to manufacturer but the basic function of all separator/densifiers is the same. My novel chute is a modified component of a typical separator/densifier 11.

The conventional separator/densifier 11 includes a stationary frame 13. The stationary frame 13 includes side walls **13*a* and a bottom wall 13*b*. A conventional endless belt type conveyor 12*a* is trained about pulleys including the upper magnetic pulley which defines the magnetic conveyor head 12. The belt conveyor 12*a* is provided with conventional transverse elements 12***b* of well-known construction.

A conventional densifier 20 is provided for compacting and compressing the cans in a well-know manner. A support brace 20*a* extends between and connects the separator 11 and densifier 20 so that the separator is disposed in an upwardly inclined condition.

Referring now to FIG. 1, it will be seen that, in a mixture of aluminum cans AL and steel cans ST, the aluminum cans AL are discharged from the conveyor belt 12*a* as the upper run thereof passes around the magnetic conveyor head 12. The aluminum cans AL fall into the densifier 20, while the steel cans ST are held against the lower run of the conveyor belt 12*a* until the steel cans ST are moved beyond the magnetic field effect produced by the magnetic conveyor head 12. At this point, the steel cans ST fall upon the lower wall 13*b* of the stationary frame 13 and slide downwardly therealong by action of gravity until these steel cans fall through an opening at the lower end of the bottom wall 13*b* into a reject barrel 21.

Figure 3:
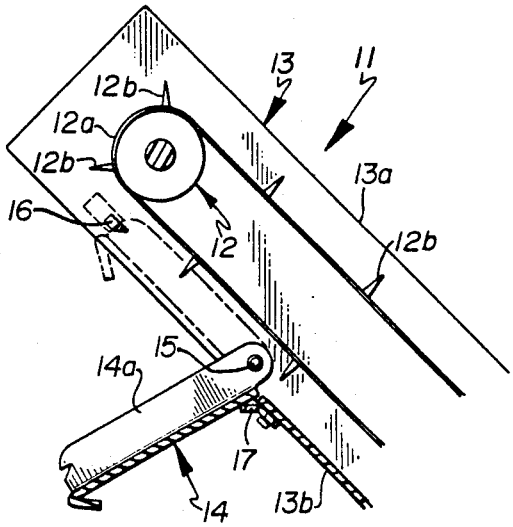
FIG. 3 is a diagrammatic side elevational view of a separator/densifier on an elongated scale and illustrating my novel chute.
Figure 4:
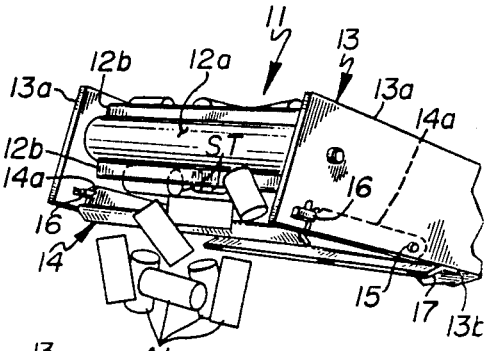
FIG. 4 is an enlarged fragmentary perspective view of the movable chute in the elevated position with respect to the conveyor apparatus.
Figure 5:
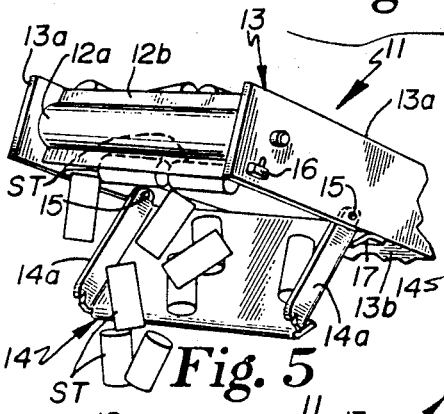
FIG. 5 is an enlarged fragmentary perspective view similar to FIG. 4 and illustrating the movable chute in the lowered position.
Figure 6:
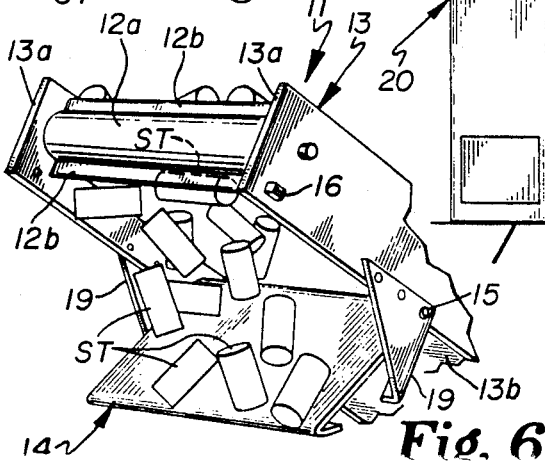
FIG. 6 is an enlarged fragmentary perspective view similar to FIG. 5 and illustrating a. slightly modified form of the movable chute.

Referring now to FIGS. 2 through 6, it will be seen that the separator/densifier 11 is provided with my novel movable chute 14. The movable chute 14 is movable between an upper or elevated position, as shown in FIG. 4, and a lowered position, as shown in FIGS. 3, 5, and 6. When the movable chute is in the elevated position, it functions as a continuation of the bottom wall 13*b*, and is used in the elevated position when aluminum cans are (separated and) directed into the densifier 20. However, when steel or ferrous containing cans are to be compressed, the movable chute is lowered, and the steel cans fall upon the movable chute 14 ard are directed by action of gravity into the densifier 20.

Referring again to FIG. 3, it will be seen that the movable chute 14 includes a pair of substantially parallel side wall elements 14*a* that are integrally formed with the chute 14 and extend upwardly at right angles thereto. In the embodiment shown, the chute is hingedly connected to the upper end of the bottom wall 13b chute by a hinge 15. A latching device 16 is also provided and releasably latches the movable chute 14 in an elevated position as seen in FIG. 4. Stopping element or device 17 is provided and limits swinging movement of the movable chute from the elevated position to the lowered position as seen in FIG. 5. With this arrangement, the chute can be readily latched in the elevated position for processing aluminum cans through the densifier and may be unlatched to permit swinging of the movable chute to a lowered position for processing of steel cans through the densifier.

Referring now to FIGS. 4, it will be seen that the movable chute 14 is shown in the up position. It will further be noted that in this position there is no substantial difference between a conventional separator and a separator with the movable chute, since the movable chute 14 contitutes an upward continuation of the fixed chute.

FIGS. 3, 4, 5 illustrate the use of the stopping device 17. When the movable chute 14 is in the elevated position, the latching device 16 secures it in place. When the movable chute is unlatched and lowered to the down position as best seen in FIG. 5, the stopping device 17 limits downward movement of the movable chute and holds it out at about the same downward angle as the bottom wall 13*b* of the stationary frame 13, but in a different direction.

FIG. 5 shows the movable chute 14 in the down position. Neither the length nor the width dimensions of the movable chute are critical, since these dimensions are contingent on the equipment to which it is installed. The movable chute is always as wide as the bottom wall 13*b* to which it is attached. The length of the movable chute must be kept at a minimum without becoming so short that it fails to intercept all material that drops down from the magnetic conveyor head 12. Ihe strength of the magnet, the speed of the conveyor belt, the distance between the belt and the chute, and the nngle of incline are all factors that would determine the length of the movable chute.

FIG. 3 shows that the movable chute 14 has longitudinal side walls or edges 14*a*, 2"–4" high that are fastened to each side of the movable chute. FIG. 6 shows a modified form of the novel chute attachment. In FIG. 6 it will be seen that the stationary guides 19 are fastened to side walls 13*a* of the stationary frame 13 of the magnetic separator in order to prevent material from spilling off the sides.

Figure 2:
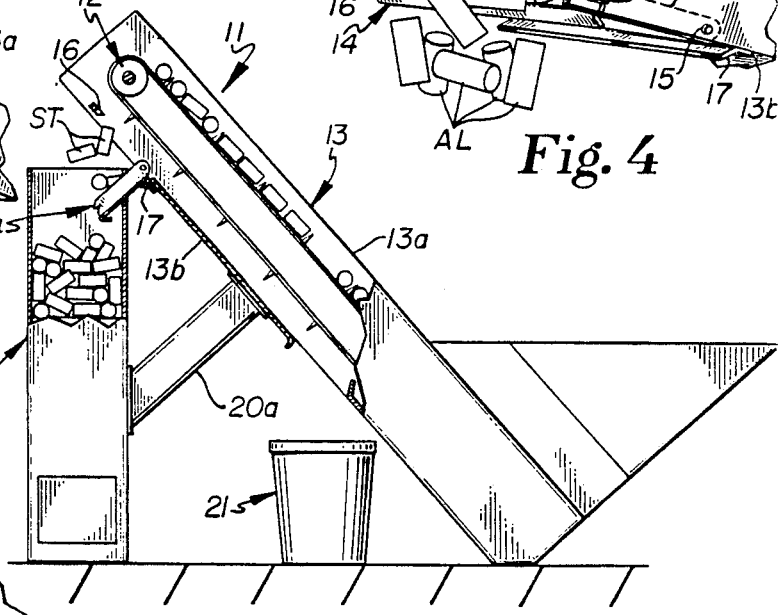
FIG. 2 is a diagrammatic side elevational view of a separator/densifier shown substantially identical to FIG. 1 and illustrating how the magnetic conveyor head separates steel cans from aluminum cans.

FIG. 2 illustrates how the movable chute 14 circumvents the effect of the magnetic conveyor head 12 allowing steel cans to drop into the hopper of the densifier. Notice how the movable chute can be lowered on its hinge device 15 so that instead of sending the steel cans down the bottom wall 13b of the stationary frame 13, it diverts the steel cans into the hopper of the densifier.

Normally the bottom wall 13b of the stationary frame 13 of a conventional magnetic separator 11 is one solid piece of steel that begins just below the magnetic conveyor head 12 and continues down to a point just above the reject barrel. Steel cans slide down this chute on their way to the reject barrel.

In the embodiment shown, the movable chute 14 is actually the upper portion of the bottom wall 13*b* of the stationary frame 13. Instead of making the bottom wall 13*b* out of one solid piece of steel, I chose to make the bottom wall out of two pieces of steel, including the movable chute 14, connected by a hinge device 15.

The movable chute 14 pivots up or down on the hinge device 15. To hold it in the up position the latching device 16 as seen in FIG. 4 is provided. This latch may be a magnet. It may be an eye and a hook. It may be a steel pin inserted into two holes that line up with each other. It may be any other kind of latch.

When the movable chute 14 is unlatched it pivots down until it is slanting down at about the same angle as the stationary reject chute 13—except that it points in the opposite direction. In the case of the CD500 Can Densor the leading edge of the movable chute comes to rest on a cross bar of the densifier. For other models it might be better to weld a permanent stop to the bottom side of the movable chute. To be able to adjust the angle, a link chain and hook could be used.

If the operator has a quantity of steel cans that he wishes to process, all he needs to do is lower the movable chute 14. This sends all the steel cans into the densifier. When the operator is finished processing steel cans and wishes to process aluminum cans, all he needs to do is to raise the movable chute and latch it in the up position.

This is a proven invention with a definite economic benefit. Though versatile enough to be adapted to virtually any separator/densifier equipment on the market, it has been put to use on the CD500 Can Densor manufactured by CP Manufacturing, Inc. of National City, Calif.

I think it is evident how this invention can quickly, easily, and inexpensively fill a growing need in the recycling industry, especially in the recycling of steel cans. The invention lends itself to the manufacture of an inexpensive conversion kit that can be installed onto existing equipment already in the field. This not only increases the value of existing equipment, but it also prevents equipment that was originally designed exclusively for aluminum cans from becoming obsolete. Furthermore, it provides an inexpensive way to build versatility into new and expensive recycling equipment.

My invention makes a tremendous improvement on the CD500 Can Densor. It can easily be adapted to improve other separator/densifier machines. Furthermore, it will work wherever there are magnetic separating machines, even where such machines are not designed specifically for cans. Because of this, the scope of this invention should be determined by the appended claims and their legal equivalents, rather than by the examples given.

What is claimed is:

1. In a magnetic separator for separating ferrous containing metal articles and nonferrous containing metal articles, including aluminum and steel cans, comprising:

an elongate upwardly inclined stationary frame having an elongate bottom wall, pair of side walls integral with said bottom wall and projecting upwardly therefrom, an upwardly inclined endless conveyor belt positioned within said stationary frame and being trained around pulley means, said pulley means including a magnetic pulley located at the upper end of the stationary frame and about which the upper end of the endless conveyor belt is trained, said endless conveyor belt including an upper run for supporting said articles thereon, and a lower run, a substantially flat movable chute having an upper end and a lower end, means pivotally connecting the lower end of said movable chute with an upper end of said bottom wall of said stationary frame to permit pivoting movement of the movable chute between elevated and lowered positions, latch means releasably latching the movable chute in the elevated position, said movable chute, when in the elevated position, constituting an upward continuation of the bottom wall of said stationary frame, and, when in the lowered position, extending angularly downwardly from the bottom wall of said stationary frame, whereby, when the movable chute is in the elevated position, nonferrous containing articles will be discharged from the upper end of the conveyor belt to a collection station, and ferrous containing articles will be directed along the bottom wall of the stationary frame, and said movable chute, when in the lowered position, directing ferrous containing articles which fall thereon from the conveyor belt to said collection station.

2. The invention as defined in claim 1 and a stopping element to limit further pivoting movement of the movable chute in a downward direction.

3. The invention as defined in claim 1 and a pair of guide wall elements for guiding ferrous containing articles downwardly along and from the moveable chute.

4. In combination with an apparatus for recycling metal articles, said apparatus comprising a magnetic separator for selectively separating ferrous containing metal articles from nonferrous containing metal articles, a densifier positioned adjacent said magnetic separator for receiving metal articles from said magnetic separator, said densifier being operable for compacting the metal articles, said magnetic separator including an elongate upwardly inclined stationary frame having an elongate bottom wall, a pair of side walls integral with said bottom wall and projecting upwardly therefrom, an upwardly inclined endless conveyor belt positioned w said stationary frame and being trained around pulley means, said pulley means including a magnetic pulley located at the upper end of the stationary frame and about which the upper end of the endless conveyor belt is trained, said conveyor belt including an upper run for supporting articles thereon and a lower run, a substantially flat moveable chute having upper and lower ends, means pivotally connecting the lower end portion of said chute with said bottom wall of stationary frame to permit pivoting movement of the moveable chute between elevated and lowered positions, latch means releasably locking the moveable chute in the elevated position, said movable chute, when in the elevated position constituting a continuation of the bottom wall of said stationary frame at the upper end portion of the bottom wall, and, when in the lowered position, extending angularly downwardly from the bottom wall of said stationary frame whereby, when the moveable chute is in the elevated position, nonferrous metal articles will be discharged from the upper end of the conveyor belt into the densifier and ferrous containing metal articles will fall from the lower run of the conveyor belt and will be directed along the bottom wall of the stationary frame; and said moveable chute, when in the lower position, directing ferrous containing metal articles which fall from teh lower run of the conveyor belt into the densifier.

* * * * *

UNITED STATES PATENT AND TRADEMARK OFFICE

CERTIFICATE OF CORRECTION

PATENT NO. : 4,967,912

DATED : November 6, 1990

INVENTOR(S) : David J. Schonberg

It is certified that error appears in the above-identified patent and that said Letters Patent is hereby corrected as shown below:

Column 1, line 48, delete "equipmetn" and insert --equipment-- therefor.

Column 1, line 51, delete "cumvent hte" and insert --cumvent the-- therefor.

Column 1, line 54, delete "equipemtn" and insert --equipment-- therefor.

Column 1, line 59, delete "a luminum" and insert --aluminum-- therefore.

Column 1, line 62, delete "mopv-" and insert --mov---therefore.

Column 2, line 14, delete "oreder" and insert --order-- therefore.

Column 4, line 9, delete "Ihe" and insert --The-- therefore.

Column 4, line 12, delete "nngle" and insert --angle-- therefore.

Column 6, line 26, delete "w" and insert--within--therefore.

UNITED STATES PATENT AND TRADEMARK OFFICE

CERTIFICATE OF CORRECTION

PATENT NO. : 4,967,912

DATED : November 6, 1990

INVENTOR(S) : David J. Schonberg

It is certified that error appears in the above-identified patent and that said Letters Patent is hereby corrected as shown below:

Column 6, line 54, delete "teh" and insert --the-- therefore.

Signed and Sealed this

Eighteenth Day of August, 1992

*Attest:*

DOUGLAS B. COMER

*Attesting Officer*

*Acting Commissioner of Patents and Trademarks*